US007000572B1

(12) United States Patent
Schimmeyer

(10) Patent No.: US 7,000,572 B1
(45) Date of Patent: Feb. 21, 2006

(54) TELESCOPIC BAFFLE FOR WATER HEATER

(76) Inventor: Werner K. Schimmeyer, 8937 Acorn Pl., Santa Rosa, CA (US) 95409

( * ) Notice: Subject to any disclaimer, the term of this patent is extended or adjusted under 35 U.S.C. 154(b) by 0 days.

(21) Appl. No.: 10/956,921

(22) Filed: Oct. 2, 2004

(51) Int. Cl.
*F22B 7/16* (2006.01)

(52) U.S. Cl. ..... 122/155.2; 122/44.2; 138/38

(58) Field of Classification Search ..... 122/155.2, 122/44.2, 13.01, 18.1, 155.4, 160; 138/38
See application file for complete search history.

(56) References Cited

U.S. PATENT DOCUMENTS 2,067,133 A * 1/1937 Wales ..... 138/38
4,823,865 A * 4/1989 Hughes ..... 185/109.1
4,869,232 A * 9/1989 Narang ..... 122/14.1
4,940,042 A * 7/1990 Moore et al. ..... 122/18.2
5,682,841 A 11/1997 Schimmeyer et al.
5,787,846 A 8/1998 Schimmeyer
6,354,248 B1 * 3/2002 Bourke ..... 122/18.31

* cited by examiner

*Primary Examiner*—Gregory Wilson
(74) *Attorney, Agent, or Firm*—Walter A. Hacker

(57) ABSTRACT

Water heater apparatus for improving the efficiency of a water heater having a tank, a burner, and a flue with the flue being disposed within the tank for evacuation of burn gases therethrough includes an enhancing heat transfer baffle with the baffle having a truncated conical shape and positioned within the flue for directing combustion gases from the burner against a flue wall.

13 Claims, 1 Drawing Sheet

TELESCOPIC BAFFLE FOR WATER HEATER

The present invention generally relates to apparatus for gas burning and/or oil burning water heaters and is more particularly adapted to apparatus for improving the efficiency of a gas burning and/or oil burning water heater, hereinafter commonly referred to as a gas water heater.

Typical fuel-burning water heaters include the combustion chamber disposed in a base of a water tank with a flue disposed within the tank for evacuation of the burner combustion gases therethrough and concomitant heating of water in the tank. The combustion gases exiting the water heater fluid typically pass through an exhaust flue for proper venting.

U.S. Pat. No. 5,682,841 to Schimmeyer describes a segmented heat deflector including cylindrical sections for enhancing heat transfer from the combustion gases through a flue wall and into surrounding water. This reference is to be incorporated herein in its entirety by this specific reference thereto in order to describe the benefits of the heat deflector and incorporate all the data presented therein.

The present invention provides apparatus for the enhancement of heat transfer from the combustion gases to the water and hot water heater through a flue with unexpected efficiencies due to a conically shaped baffle.

SUMMARY OF THE INVENTION

Apparatus in accordance with the present invention for improving the efficiency of a hot water heater having a tank, a burner, and a flue generally includes an enhancing heat transfer baffle with the baffle including a truncated conical shape and positioned within the flue directing combustion gases from the burner against the flue wall. Preferably, the baffle comprises a tapered tube having an exterior truncated conical shape.

In a preferred embodiment of the present invention, the baffle is segmented in order to enable retrofitting of the baffle in water heaters having limited clearances thereabove when installed. A newly manufactured water heater in accordance with the present invention accordingly includes a tank, a burner, a flue disposed in the tank evacuating combustion gases therethrough and heating water in the tank and a one piece baffle with the baffle having a truncated conical shape and positioned within the flue for directing combustion gases from the burner against a flue wall.

With regard to the segmented baffle, preferably three segments are provided and in order to efficiently enhance heat transfer through the flue wall and into water disposed in the water tank, the top segment and the middle segment may include closed tops.

Further, the bottom segment may include a divider and a top thereof with the divider having an opening therein. This enhances heating of the lower segments by combustion gases to prevent laminar flow therealong, which may otherwise occur by a relatively cool baffle.

In addition, tabs may be provided for centering a baffle within the flue.

BRIEF DESCRIPTION OF THE DRAWINGS

The advantages and features of the present invention will be better understood by the following description when considered in conjunction with the accompanying drawings in which.

DETAILED DESCRIPTION

Figure 1:
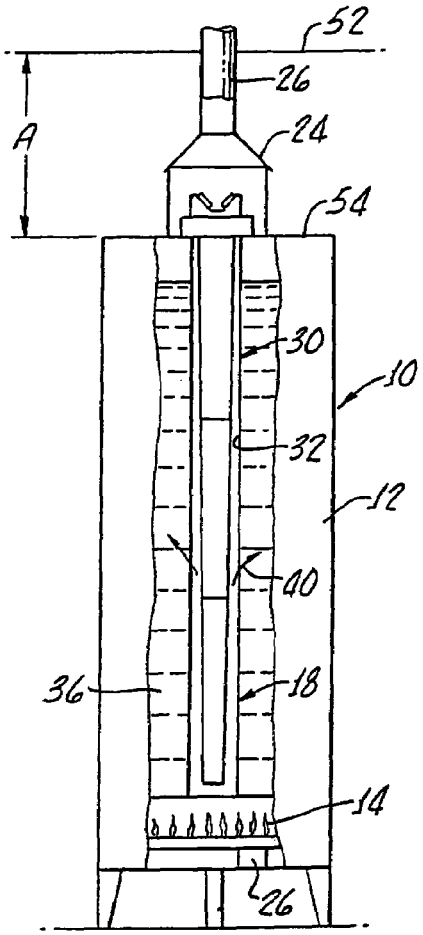
FIG. 1 is a plan view, partially broken away, of the present invention generally showing a water tank with a flue therethrough heated by a burner in combination with a baffle for enhancing heat transfer through a flue wall.

With reference to FIG. 1, there is shown a hot water heater apparatus 10 in accordance with the present invention which generally includes a tank 12, a burner 14, disposed at a bottom portion 16 of the tank along with a flue 18, which provides a means for evacuation of burner gases therethrough to a vent damper 24 and thereafter to an exhaust flue 26.

It should be appreciated that the tank 12, burner 14, and flue 18 of the apparatus 10 may be of any conventional suitable design. In addition, the vent damper 24 may be made in accordance with U.S. Pat. No. 4,770,160 or 5,239,947, which are incorporated herewith in their entirety for providing a description of how to make and use the vent damper 24.

Figure 2:
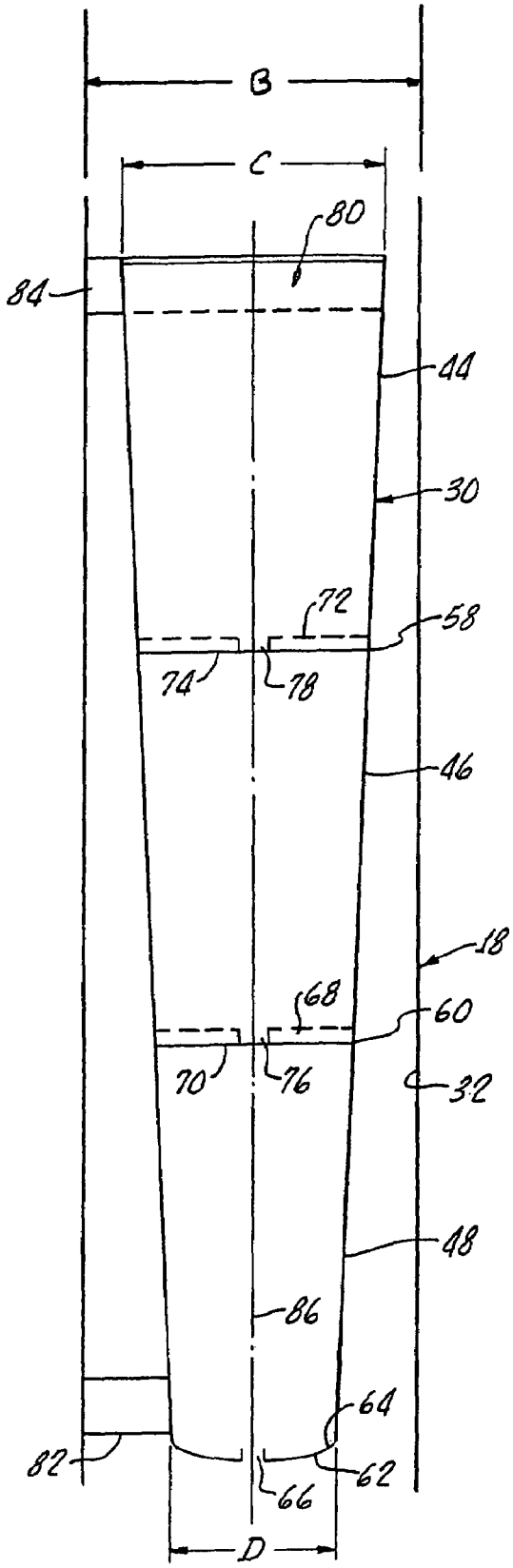
FIG. 2 is an enlarged plan view of the baffle shown in FIG. 1 positioned within the flue by tabs and including three segments of conically shaped tubes.

As shown in FIGS. 1 and 2, a baffle 30 is provided for enhancing heat transfer from combustion gases through a flue wall 32 and into surrounding water 36, as indicated by the arrows 40 in FIG. 1.

While the baffle 30 may be formed from a single piece of tubular material with a generally truncated conical shape for retrofit applications, the baffle in accordance with the present invention may generally include a top segment 44, a middle segment 46, and a bottom segment 48, as more clearly shown in FIG. 2. Preferably, the flue segments 44, 46, 48 are formed from polished stainless steel material in order to further reflect the heat into the flue wall 32.

With a clearance A between a ceiling 52 and a tank top 54, the segments 44, 46, 48 should preferably have a length each of less than about 15 inches. For a typical flue diameter B of about 4 inches, the top segment 44 has a maximum diameter C of about 2-¼ inches and the bottom segment 48 has a minimum dimension D of about 1-½ inches.

As shown in FIG. 2, it should be appreciated that adjacent tapered segments, or tubes, 44, 46 and 46, 48 have substantially equal diameters yet junctions 58, 60.

In order to effect proper heat deflection into the flue wall 32 while at the same time properly heating the baffle 32 to promote such heat transfer, the lower, or bottom, segment 42 includes a pan 62 disposed at a bottom 64 of the segment 48 with the pan 62 including an opening 66.

In addition, the middle segment 46 may include a pan, or closure, 68 disposed at a bottom 70 thereof and the top segment 44 includes a pan, or closure, 72 at a bottom 74 thereof, with the pans 68, 72 having holes 76, 78 therein. The top segment may include a cap 80. In order to center the baffle 30 within the flue 18, tabs 82, 84 disposed at 120° intervals around a centerline 86 on the bottom segment 48 and top segment 44 respectively, only two being shown in FIG. 2.

While similar in structure to the baffle shown in U.S. Pat. No. 5,787,846, the conical shape of the baffle 30 produces remarkable and unexpected efficiency when compared to the segmented cylindrical baffle described in U.S. Pat. No. 5,787,846, as hereinafter set forth in the hereinafter example.

EXAMPLE

In a 40 gallon gas fired water heater 10 with the baffle described in U.S. Pat. No. 5,682,841, the control setting was moved from a vacation setting to a normal hot water temperature after withdrawal of 5 gallons of hot water. The recovery time for the heater 10 to bring the water temperature to the set temperature was 5 minutes.

In a comparative test, the baffle described by U.S. Pat. No. 5,682,841 was removed in a baffle in accordance with the present invention installed into the water heater and the heater moved from a vacation to the same set temperature. The recovery time was 3 minutes and 30 seconds. This is about a 30% reduction in time or savings of 23% of gas usage, which is certainly unexpected in view of the shape difference between the two baffles.

Although there has been hereinabove described a specific telescoping baffle for water heater in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element, which is not specifically disclosed herein. Accordingly, any and all modifications, variations or equivalent arrangements which may occur to those skilled in the art, should be considered to be within the scope of the present invention as defined in the appended claims.

What is claimed is:

1. Apparatus for improving the efficiency of a water heater having a tank, a burner, and a cylindrical non-tapered flue being disposed within said tank for evacuation of burned combustion gases therethrough with resulting heating of water in said tank, said apparatus comprising:

an enhancing heat transfer baffle, the comprising a tapered tube positioned within the flue directing combustion gases from the burner against a flue wall, the tube tapering in a continuous manner from a baffle top to a baffle bottom.

2. The apparatus according to claim 1 wherein the baffle is segmented, each segment being a tapered tube, adjacent tapered tubes having substantially equal diameters.

3. The apparatus according to claim 2 wherein the baffle includes three segments.

4. The apparatus according to claim 3 wherein a top segment and a middle segment have closed tops.

5. The apparatus according to claim 4 wherein a bottom segment includes a divider disposed at a top of said bottom segment, said divider having an opening therein.

6. The apparatus according to claim 5 further comprising tabs centering the baffle within the flue.

7. Water heater apparatus comprising:

a tank;

a burner;

a cylindrical non-tapered flue disposed in said tank evacuating burner combustion gases therethrough heating water in said tank; and a baffle, said baffle comprising a tapered tube positioned within said flue directing combustion gases from said burner against a flue wall, the tube tapering in a continuous manner from a baffle top to a baffle bottom.

8. The apparatus according to claim 7 wherein the baffle is segmented, each segment being a tapered tube, adjacent tapered tubes having substantially equal diameters.

9. The apparatus according to claim 8 wherein the baffle includes three segments.

10. The apparatus according to claim 9 wherein a top segment and a middle segment have closed tops.

11. The apparatus according to claim 10 wherein a bottom segment includes a divider disposed at a top of said bottom segment, said divider having an opening therein.

12. The apparatus according to claim 11 further comprising tabs centering the baffle within the flue.

13. The apparatus according to claim 7 wherein said baffle is formed from polished stainless steel in order to reflect heat onto a flue wall.

* * * * *